US006499524B1

(12) United States Patent
Miller et al.

(10) Patent No.: US 6,499,524 B1
(45) Date of Patent: Dec. 31, 2002

(54) DISPENSER FOR APPLYING A MATERIAL TO A SURFACE

(75) Inventors: Crispin M. Miller, Lincoln, MA (US); Jean L. Spencer, Boston, MA (US); John M. Fritz, Watertown, MA (US); William Baird Shambley, Billerica, MA (US); Vitaly Pesikov, Canton, MA (US)

(73) Assignee: Berol Corporation, Freeport, IL (US)

( * ) Notice: Subject to any disclaimer, the term of this patent is extended or adjusted under 35 U.S.C. 154(b) by 0 days.

(21) Appl. No.: 09/390,965

(22) Filed: Sep. 7, 1999

(51) Int. Cl.[7] ..... B32B 31/00

(52) U.S. Cl. ..... 156/577; 156/523; 156/579; 118/76; 242/160.4; 242/171; 242/588.6; 206/411

(58) Field of Search ..... 156/184, 185, 156/189, 574, 577, 579, 523, 527, 238, 540; 242/588.2, 588.6, 160.2, 160.4, 588, 588.3, 170, 171; 225/46, 56, 57; 118/200, 76, 257; D19/67

(56) References Cited

U.S. PATENT DOCUMENTS

| | | | | | |
|---|---|---|---|---|---|
| 2,746,696 | A | * | 5/1956 | Tierney | 206/411 |
| 3,211,604 | A | * | 10/1965 | Rymer | 156/577 |
| 3,737,360 | A | * | 6/1973 | Horn | 156/577 |
| 3,913,522 | A | * | 10/1975 | Light | 118/419 |
| 4,197,348 | A | * | 4/1980 | Townsend | 156/185 X |
| 4,568,415 | A | * | 2/1986 | Woltron | 156/185 |
| 5,006,184 | A | | 4/1991 | Manusch et al. | 156/577 |
| 5,049,229 | A | | 9/1991 | Czech | 156/577 |
| D323,531 | S | * | 1/1992 | Fortune | D19/67 |
| 5,310,437 | A | | 5/1994 | Tucker | 156/238 |
| D361,087 | S | * | 8/1995 | van Eijben et al. | D19/67 X |
| 5,820,728 | A | * | 10/1998 | Stevens et al. | 156/577 |
| D410,034 | S | * | 5/1999 | Grobbel | D19/67 X |
| D410,494 | S | | 6/1999 | Hoffmann | D19/69 |
| 6,276,859 | B1 | * | 8/2001 | Hsu | 15/435 |
| 6,340,126 | B1 | * | 1/2002 | McAlpine et al. | 242/160.2 |

FOREIGN PATENT DOCUMENTS

| | | | |
|---|---|---|---|
| DE | 41 04 331 A1 | 8/1992 | B05C/17/00 |
| EP | 0 551 522 B1 | 3/1998 | B43L/19/00 |
| JP | 10/309892 | 11/1998 | |

OTHER PUBLICATIONS

Albanese et al., Wire Ribbon Dispensing Tool, Jul., 1981, Western Electric Technical Digest, No. 63.*

International Search Report in PCT/US00/23492 dated Jan. 4, 2001.

* cited by examiner

*Primary Examiner*—Mark A. Osele
(74) *Attorney, Agent, or Firm*—Marshall, Gerstein & Borun

(57) ABSTRACT

A dispenser for applying a material to a surface includes a supply spool rotatable about an axis, a quantity of unused tape stored on the supply spool, and an applicator head about which the tape is passed. The head presses the tape against a surface to deposit a transfer layer of the tape onto the surface. A take-up spool stores a backing layer of the tape after the transfer layer has been deposited on the surface. The take-up spool is also rotatable about the axis. A housing surrounds at least a majority of the tape, a substantial portion of the housing being substantially cylindrical in shape. The tape is guided from the supply spool to the head and from the head to the take-up spool. The applicator head is located substantially along the axis, and the spools are movable along the axis. The tape causes movement of the spools along the axis as the spools are rotated about the axis. The-tape is stored on each spool in a plurality of tape layers thick and a plurality of tape widths wide.

73 Claims, 5 Drawing Sheets

DISPENSER FOR APPLYING A MATERIAL TO A SURFACE

FIELD OF THE INVENTION

The invention relates generally to the field of material dispensers, and in particular to dispensers from which a material is deposited to a surface from a tape stored in the dispenser.

BACKGROUND OF THE INVENTION

Correction tape dispensers are used to apply a thin, white, opaque piece of correction tape over visible markings which have been made on a surface. Typically, the tape is used to cover a mistake in text on a piece of paper. After the tape has been applied over the mistake, the correct text can be written on top of the tape to fix the mistake.

U.S. Pat. No. 5,490,898 discloses a fairly typical arrangement of a correction tape dispenser (coating film transfer tool). The tool includes a case 2 formed in a flat box-like shape. Case 2 contains a pay-out reel 6 with a coating film transfer tape T wound thereabout, and a winding reel 7 for collecting the used tape T'. A tape drive D connects the two reels to maintain tension in the tape. The tape includes a backing layer which remains on the reels, and a covering layer for covering the visible image on the surface. Tape T passes around a transfer head H as the tape travels from reel 6 to reel 7. The arrangement of head H causes the tape covering layer to be deposited on the surface contacted by the tape while under pressure from the user.

Tape T and used tape T' are stored respectively on reels 6 and 7 in a multi-layer thick/single-layer wide arrangement. This way of storing the tape on the reels, and the arrangement of the reels relative to each other and to head H causes the case to have the flat box-like shape. Having this case in such a shape is less than optimal for a correction tape dispenser. First, the case can at least partially block the user's view of the material being corrected. Second, users would find a dispenser shaped more along the lines of a writing instrument (e.g. a cylindrically shaped pen or pencil) more natural to use when correcting writing on paper.

U.S. Pat. No. 5,049,229 discloses an apparatus for the application of an adhesive film in which the supply reel 5 and take-up reel 11 are both mounted on a shaft or axis 9. The tape is stored on these reels in a manner similar to that described in the previous paragraph (i.e. a multi-layer thick/single-layer wide arrangement). Such an arrangement also results in an apparatus shape having the drawbacks mentioned at the end of the previous paragraph.

SUMMARY OF THE INVENTION

The present invention is directed to overcoming one or more of the problems set forth above. Briefly summarized, according to one aspect of the present invention, a dispenser for applying a material to a surface includes a spool rotatable about an axis and a quantity of tape stored on the spool. The tape is passed around an applicator head, the head pressing the tape against a surface to deposit at least a portion of the tape on the surface. The applicator head is located substantially along the axis.

According to another aspect of the invention, a dispenser for applying a material to a surface includes a spool rotatable about an axis. The spool is movable along the axis. A quantity of tape is stored on the spool, the tape causing movement of the spool along the axis as the spool is rotated about the axis.

In accordance with a further aspect of the invention, a dispenser for applying a material to a surface includes a spool and a quantity of tape stored on the spool. The tape has a thickness, a width and a length, and is stored on the spool in a plurality of tape layers thick and a plurality of tape widths wide.

According to another aspect of the invention, a dispenser for applying a material to a surface includes a quantity of tape and a housing which surrounds at least a majority of the tape. A substantial portion of the housing is substantially cylindrical in shape.

The various features of the invention described above enable a correction tape dispenser which is more in the shape of a writing instrument, and thus more naturally wielded by a user of the dispenser.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE INVENTION

Figure 1:
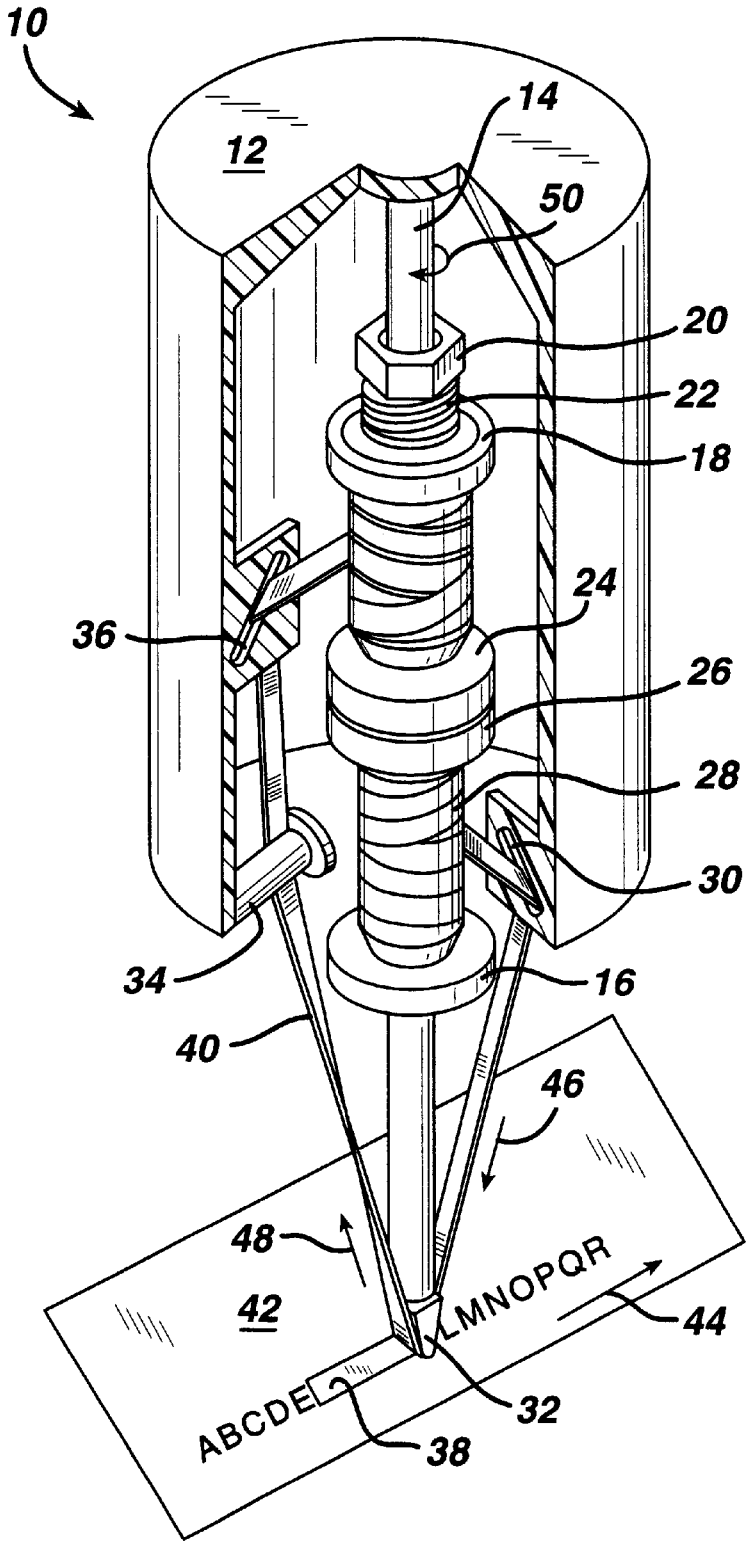
FIG. 1 is a perspective view of a first embodiment of a correction tape dispenser according to the invention.

Beginning with FIG. 1, a correction tape dispenser 10 includes a housing 12, a portion of which has been removed to facilitate viewing of the inside of the dispenser. The housing is preferably made of plastic and is substantially cylindrical in shape. An axle 14 extends down from the top of the housing. A cross section of housing 12 taken perpendicular to the axle is preferably circular or oval in shape (the housing diameter has been exagerated for clarity). The axle is fixed to the housing such that it can either (a) rotate about its long axis, or (b) not rotate about its long axis. If the axle is rotatable, this allows an applicator head 32 secured to an end of the axle to rotate freely about the long axis of the axle. Alternatively, the axle can be arranged to be manually rotated to fixed orientations about its long axis by a ratcheting mechanism (not shown) so that the head can be rotated or swiveled to fixed orientations about the long axis of the axle.

A supply spool 16 and a take-up spool 18 are rotatably supported on axle 14. The spools are secured together by a nut 20 and spring 22, and a flange 24 of spool 18 and a flange 26 of spool 16 interface to form a clutch between the two spools(operation of the nut, spring and flanges will be explained in more detail below with respect to FIG. 3). As a result, spools 16 and 18 are movable in unison along axle 14 and can rotate freely about the axle, although the clutch provides some resistance to the spools rotating about the axle relative to each other.

A supply of unused correction tape 28 is stored on spool 16. The tape has a thickness, width and length, and is stored on spool 16 in a plurality of layers thick and a plurality of widths wide (similar to thread on a spool). Preferably the tape has a width to length ratio of 0.01 or less. Tape 28 is guided off spool 16 by a first guide slot 30 which extends inward of the housing. The tape then passes around an applicator head 32, past a guide bar 34, through a second guide slot 36, and onto take-up spool 18. Axle 14 and head 32 are preferably made of plastic, thus allowing the head to flex during use.

Head 32 is at least partially located within an imaginary cylindrical space of unlimited length generated around axis 14. The radius of this cylindrical space is equal to the radius of the large spool when this spool is full (in this case the take-up spool). If the two spools were not coaxial, then this cylindrical space would be generated around the axis of the spool close to head 32, with the radius of the cylindrical space equal to the radius of the spool when this spool is full.

As is well known in the art, the tape includes a masking layer 38 and a backing layer 40. To use the dispenser, a user grasps housing 12, presses head 32 against a surface 42 (in this case the head contacts surface 42 just after the letter "E"), and moves the dispenser in the direction of an arrow 44. This causes tape 28 to unwind from spool 16, move in the direction of arrows 46 and 48, and wind up on spool 18. This tape movement causes the spools to rotate in the direction of arrow 50. The tape movement also causes the spools to move up or down along axis 14 because guide slots 30, 36 are fixed on the housing and the tape unwinds from spool 16 back and forth from one end of the spool to the other. Rather than a masking layer, the tape may alternatively carry a layer of material for highlighting, marking, labeling, transferring decals, scenting, gluing, bonding, adhering, removing debris, or applications in the cosmetic and medical areas.

Alternatively, the spools can be fixed so that they do not move up and down along axis 14 while guides 30, 36 are each mounted for movement on a rod (not shown) which is parallel to axis 14. As such, the guides will move up and down on their respective rods as the tape unwinds from supply spool 16 and rewinds onto take-up spool 18 while the spools themselves will not move up and down along the axis.

As is well known in the art, the adherence of masking layer 38 to surface 42 (e.g. one side of a piece of paper) is greater than the adherence of masking layer 38 to backing layer 40. As a result, masking layer 38 peels away from backing layer 40 and adheres to surface 42, covering up some letters in the process. When the dispenser is lifted off surface 42, masking layer 38 on surface 42 tears free from the masking layer still on tape 28.

The diameter of the take-up spool is greater than the diameter of the supply spool. The reason for this diameter difference is to enable the take-up spool to rewind the backing layer faster than the new tape is being paid out from the supply spool, thereby taking up any slack that may inadvertently be created at head 32. This diameter difference would cause a steady increase in tape tension as the dispenser is used, but the clutch between the two spools 16, 18 relieves this tension buildup and maintains a fairly constant tension in tape 28.

Figure 2:
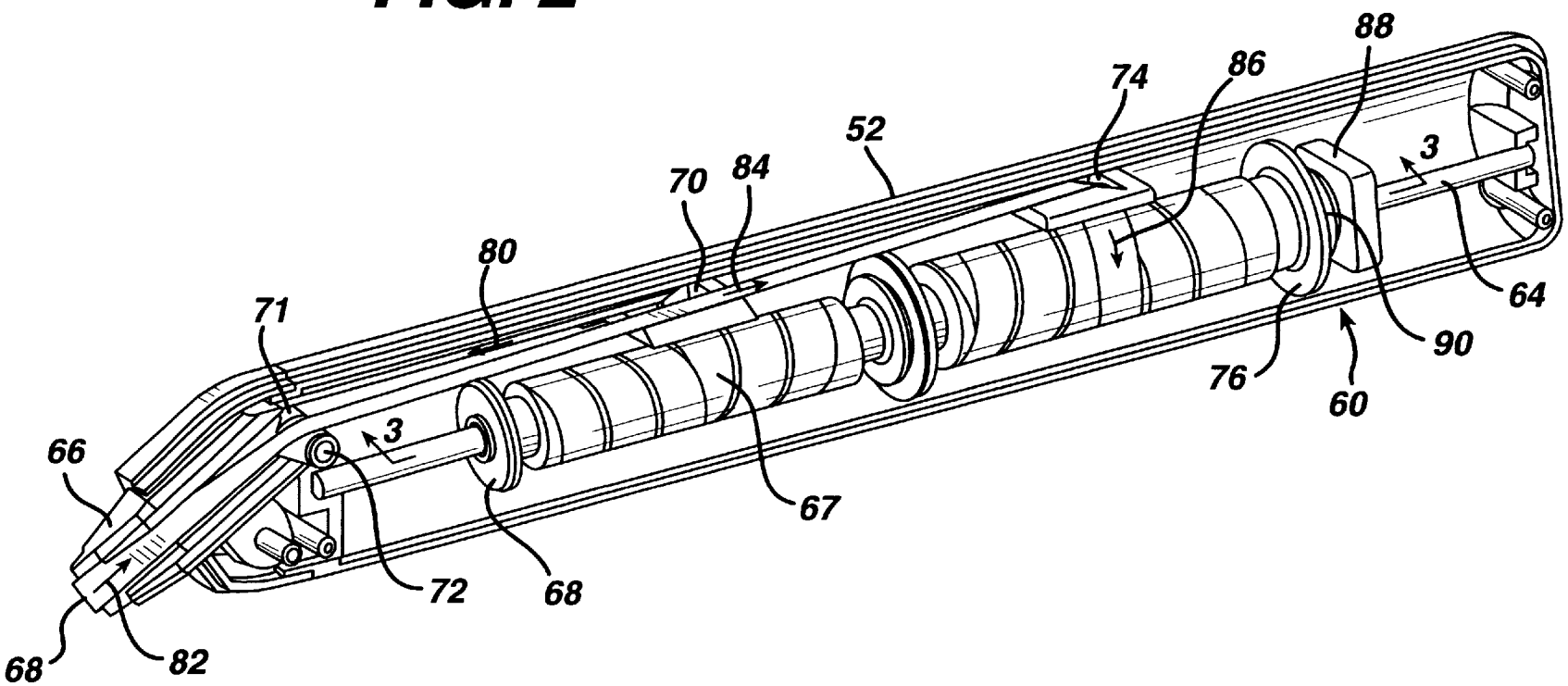
FIG. 2 is a perspective view of a second embodiment of a correction tape dispenser.
Figure 3:
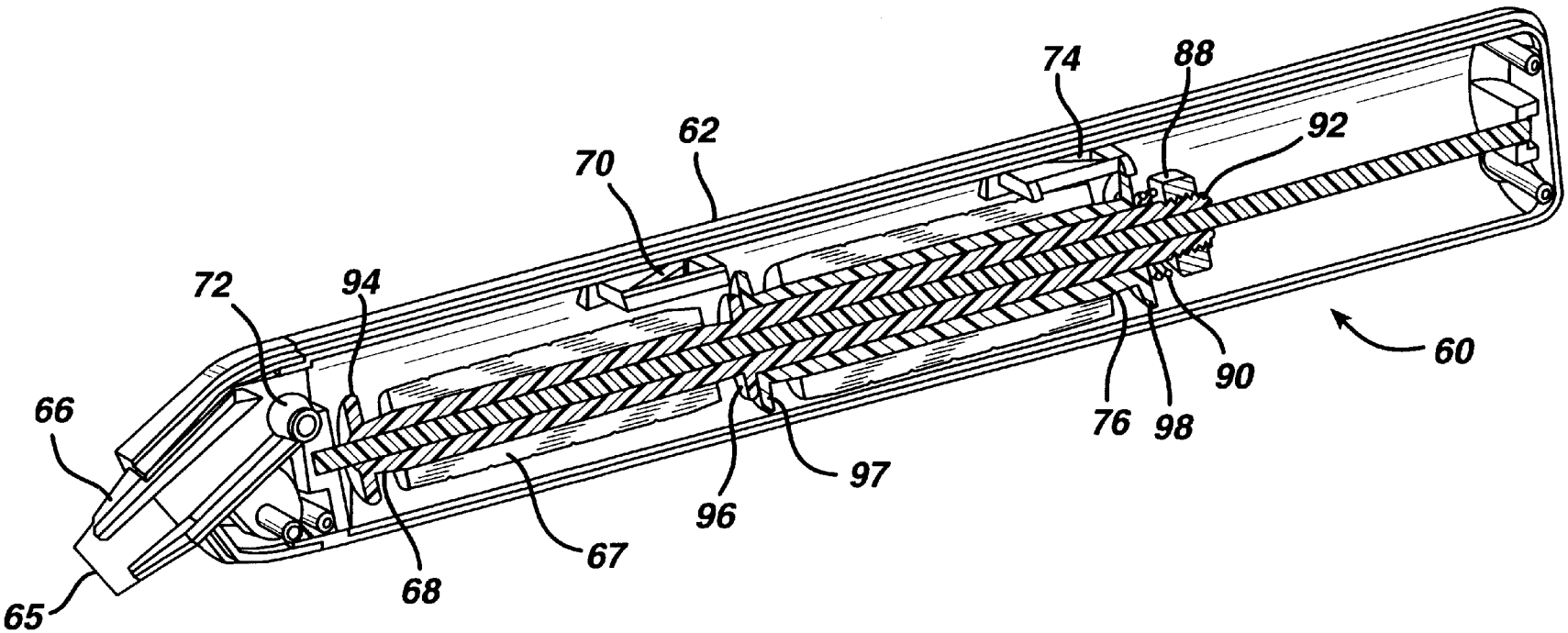
FIG. 3 is a partial sectional view of FIG. 2 taken along the lines 3—3.

Turning to FIGS. 2 and 3, a second embodiment of the invention will be described. Many of the features of this embodiment are similar to features found in the first embodiment. A correction tape dispenser 60 includes a housing 62 which is substantially cylindrical (having a circular or oval cross section) along most of its length (½ the housing is not shown to facilitate viewing of the inside of the dispenser). The dimensions of this housing are similar to that of a writing instrument such as a porous-tip marker. The design can be altered so that the housing dimensions approach those of a traditional pen.

In this embodiment an axle 64 is secured to a forward and rearward part of the housing. The axle does not rotate about its long axis. An applicator head 66.is secured to the housing rather than to the axle as in FIG. 1. Although head 66 is shown as having an edge 65 about which the tape is wrapped, edge 65 could be replaced by an alternative arrangement such as a cylindrical roller. Edge 65 lies on a line of contact between the tape and the surface being corrected. This line extends in a direction which intersects the axis about which the spools rotate. In this embodiment the intersection is at an acute angle, while in the FIG. 1 embodiment, the intersection is at a right angle.

The path of tape 67 in this embodiment has some similarities to the tape path in the first embodiment (FIG. 1). The tape unwinds from a supply spool 68 and passes through a guide slot 70. The tape then travels down the dispenser, passes over a cylindrical guide 71 (FIG. 2) and twists about 90 degrees about its longitudinal axis behind head 66 as viewed in FIGS. 2 and 3. Guide 71 is tapered and somewhat conical (a truncated cone) to facilitate the tape veering toward a midplane of the dispenser. After wrapping around head 66, tape 67 again twists about 90 degrees about its longitudinal axis, and passes over another cylindrical guide 72 which is similar in shape to guide 71. The tape then extends over guide slot 70 and passes through a second guide slot 74, after which the used tape is wound onto take-up spool 76. With the tape coming off the side of spool 68 facing the housing (as shown in FIG. 2), arrows 80, 82, 84 and 86 indicate the path of travel of the tape. In both this embodiment and the embodiment of FIG. 1, each tape layer wound on the spool is in the form of a helix traversing substantially a full axial length of the winding region of the spool.

With reference to FIG. 3, operation of a nut 88 and spring 90 along with spools 68 and 76 will be described. This assemblage holds the two spools together to form a clutch between the spools. Spool 68 actually extends all the way through spool 76 and ends in a threaded portion 92. Spool 68 has a flange 94 at one end and a flange 96 about midway along the spool. Spool 76 surrounds spool 68 and includes a flange 97 at one end and a flange 98 at the other end. Nut 88 is screw-threaded onto threaded end 92 of spool 68 to press spring 90 against flange 98 of spool 76. This arrangement presses flanges 96 and 97 against each other, forming a friction clutch. In this embodiment there is minimal friction between spool 68 and axle 64.

Operation of the dispenser of FIGS. 2 and 3 is essentially the same as for the dispenser of FIG. 1. The tape is maintained under tension and travels from spool 68, around head 66, and back to spool 76. This tape movement causes the spools to rotate about axle 64, with the clutch allowing the spools to slip rotationally relative to each other to maintain tape tension fairly constant. The tape movement also causes the spools to move in unison up and down on axle 64 as the tape unwinds from spool 68 and rewinds on spool 76.

FIGS. 6(*a*)–(*d*) show some of the possible applicator head orientations. A head 130 in FIG. 6(*a*) is similar to head 66 in FIGS. 2 and 3 in that the center of head edge 132 is below a centerline 134 of a housing 136. FIG. 6(*b*) discloses a head 138 in which the center of a head edge 140 is along centerline 134 of a housing 142. FIG. 6(*c*) discloses a head 144 in which a centerline 145 of head 144 is parallel to a centerline 146 of a housing 148. FIG. 6(*d*) discloses a head 150 in which a centerline of the head and centerline 146 of housing 152 are co-linear.

The four head positions shown in FIGS. 6(*a*)–(*d*) can be defined by an angle between a centerline of the head and a perpendicular line from the centerline of the housing, and by the perpendicular distance from the centerline of the housing to the centerline of the head where it enters the housing. There could be many more head orientations defined by these two parameters. In addition, the head can be made to swivel freely along the angle to fixed settings. The head could also be made to swivel freely around its centerline while it is swiveling freely along the angle.

Figure 4:
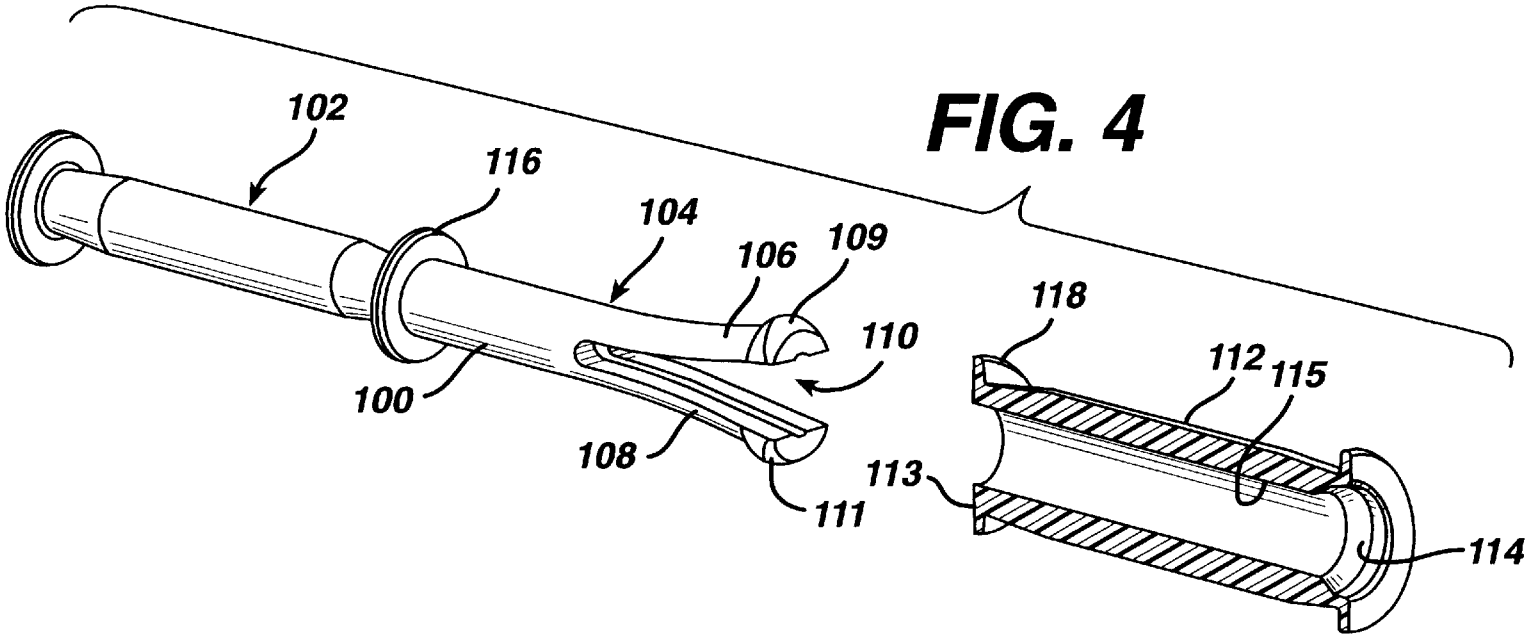
FIG. 4 is a partial sectional exploded view of an alternative pair of spools usable in the invention.
Figure 5:
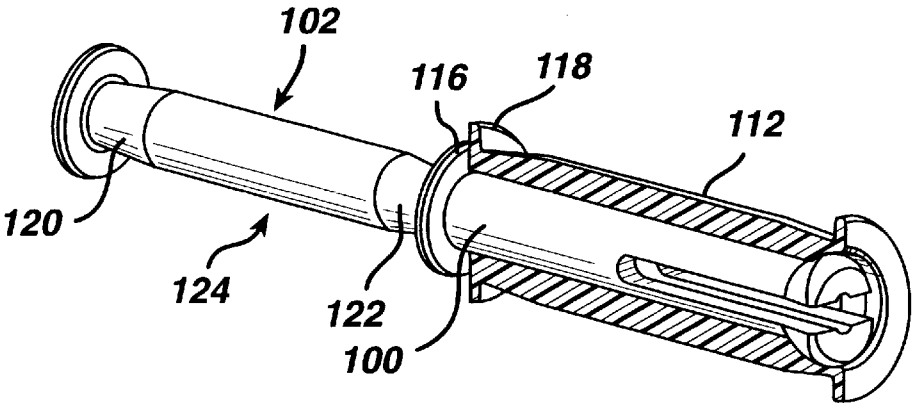
FIG. 5 is a partial sectional exploded view of the spools of FIG. 4 assembled together.
Figure 6B:
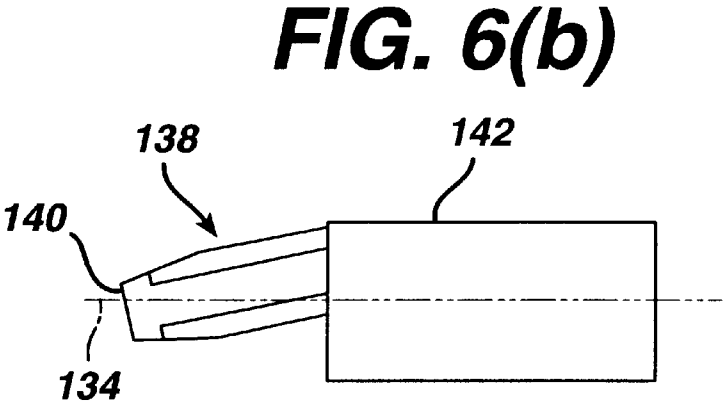
FIGS. 6(*a*)–(*d*) are schematic side views showing various orientations of an applicator head to its housing.
Figure 6D:
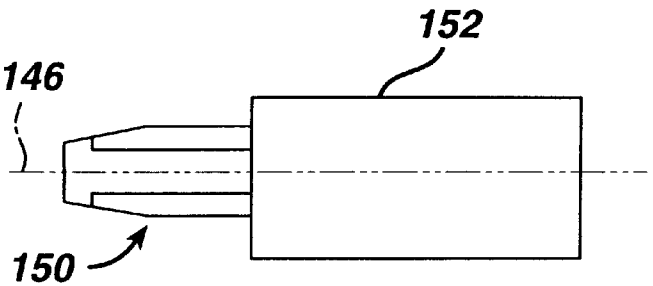
Figure 6A:
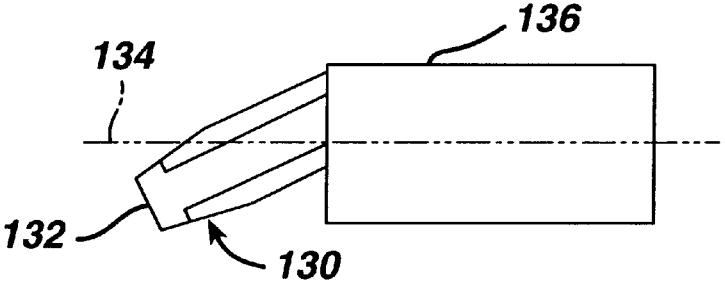
Figure 6C:
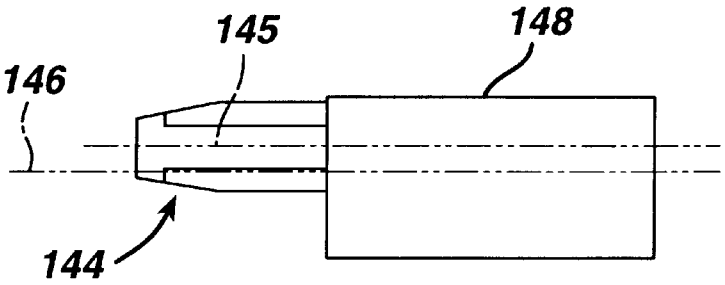

Turning to FIGS. 4 and 5, an alternative embodiment of the spools is disclosed. A supply spool 100 is similar in its lower end 102 to spool 68. The upper end 104 of the spool however is different. Spool 100 is made of plastic and is injection molded to have the shape shown in FIG. 4. Spool 100 is partially split lengthwise at end 104 and has a pair of arms 106 and 108. Spool 100 is molded to have a gap 110 between the arms, and a flared portion 109, 111 at the end of each arm. A take-up spool 112 is similar to spool 76 except that an internal annular recess 114 is provided at one end of the spool (half the take-up spool is not shown to facilitate viewing).

Spools 100 and 112 are assembled by pressing arms 106, 108 together and inserting them into an end of spool 112. Gap 110 between the arms allows them to compress sufficiently to fit inside spool 112. Spool 100 is inserted into spool 112 until flared portions 109, 111 of the arms press into annular recess 114 due to the inherent spring characteristics of the arms. Portions 109, 111 and recess 114 hold the spools together. Radially outward force by arms 106 and 108 on surfaces 113 and 115 of take-up spool 112 creates friction between upper spool end 104 and take-up spool 112 to form a friction clutch. Some frictional resistance can also be provided between flanges 116 and 118. This embodiment eliminates the nut and spring of the earlier embodiments.

Referring to FIG. 5, each end portion 120, 122 of a winding region 124 of spool 100 decreases in diameter towards its respective spool end to stabilize a turn in the winding at the end of each layer, in which turn a helix angle of the helically wound tape reverses, and to facilitate that reversal of helix angle between one helical layer and the next helical layer which spirals in the opposite direction. In other words, the maximum winding diameter of each spool (without any tape on the spool) is in the central region of the spool. This same feature is found on spool 112 and the other spools discussed above.

The invention has been described with reference to a preferred embodiment. However, it will be appreciated that variations and modifications can be effected by a person of ordinary skill in the art without departing from the scope of the invention. For example, rather than applying a white, opaque correction layer to a surface, a tinted transparent highlight layer or other type of layer can be applied. Also, a further embodiment can utilize only one spool such as a single supply spool which can deliver a backingless tape, or a single take-up spool which can be driven by a roller applicator head.

What is claimed is:

1. A dispenser for applying a material to a surface, comprising:

a supply spool rotatable about an axis;

a quantity of material stored on the supply spool in a plurality of widths wide; and an applicator head about which the material is passed, the head pressing the material against the surface.

2. The dispenser of claim 1, wherein each layer of material on the supply spool is in the form of a helical winding traversing substantially a full length of a winding region of the spool.

3. The dispenser of claim 1, wherein the maximum diameter of a winding region of the supply spool is in the central region of the spool.

4. The dispenser of claim 1, further including a guide, wherein the material from the supply spool passes through the guide before reaching the applicator head, the guide being movable along an axis parallel to the axis of the spool.

5. The dispenser of claim 1, wherein the applicator head is free to rotate about an axis.

6. The dispenser of claim 5, wherein the supply spool and applicator head rotate about the same axis.

7. The dispenser of claim 1, wherein the applicator head can swivel about an axis to fixed orientations.

8. The dispenser of claim 7, wherein the supply spool and applicator head rotate about the same axis.

9. The dispenser of claim 1, further including a housing for containing the spool, the housing being substantially cylindrical in shape.

10. The dispenser of claim 1, wherein the material is for correction.

11. The dispenser of claim 1, wherein the material is selected from the group consisting of materials for masking, highlighting, marking, labeling, transferring decals, scenting, gluing, bonding, adhering, removing debris, and materials in the cosmetic and medical areas.

12. The dispenser of any one of claims 1–3 and 5–11, wherein the supply spool is also movable along the axis.

13. The dispenser of any one of claims 1 and 5–11, further including a take-up spool rotatable about an, axis, the material passing from the supply spool about the applicator head and onto the take-up spool.

14. The dispenser of claim 13, wherein each layer of material on the supply spool and on the take-up spool is in the form of a helical winding traversing substantially a full length of a winding region of each spool.

15. The dispenser of claim 13, wherein the maximum diameters of the supply spool and the take-up spool are in the central region of a winding region of each spool.

16. The dispenser of claim 13, further including first and second guides, wherein the material from the supply spool passes through the first guide before reaching the applicator head, the first guide being movable along an axis parallel to the axis of the supply spool;

wherein the material which has passed the applicator head passes through the second guide before being collected on the take-up spool, the second guide being movable along an axis parallel to the axis of the take-up spool.

17. The dispenser of claim 16, wherein the first and second guides are mechanically coupled at a fixed spacing approximately equal to the distance between the centers of the axial lengths of the supply spool and the take-up spool.

18. The dispenser of claim 13, wherein the rotation of the supply spool drives the rotation of the take-up spool by means of one or more mechanical elements.

19. The dispenser of claim 18, further including a clutch which allows variation in a rotation rate of the take-up spool relative to a rotation rate of the supply spool.

20. The dispenser of claim 13, wherein the supply spool and the take-up spool are coaxial.

21. The dispenser of claim 13, further including a pair of guides for respectively guiding the material off the supply spool and onto the take-up spool, the guides being mounted to move as the material is taken off the supply spool and recovered onto the take-up spool.

22. The dispenser of any one of claims 1 and 5–11, further including a take-up spool rotatable about an axis and movable along the axis, the supply spool also being movable along its axis, the material passing from the supply spool about the applicator head and onto the take-up spool, a quantity of material stored on the take-up spool being in a plurality of widths wide.

23. The dispenser of claim 22, wherein each layer of material on the supply spool and on the take-up spool is in the form of a helical winding traversing substantially a full length of a winding region of the spool.

24. The dispenser of claim 22, wherein the maximum diameters of the supply spool and the take-up spool are in the central region of a winding region of each spool.

25. The dispenser of claim 22, wherein the rotation of the supply spool drives the rotation of the take-up spool by means of one or more mechanical elements.

26. The dispenser of claim 25, wherein a clutch allows variation in a rotation rate of the take-up spool relative to a rotation rate of the supply spool.

27. The dispenser of claim 22, wherein the supply spool and the take-up spool are coaxial.

28. A dispenser for applying a material to a surface, comprising:

a supply spool rotatable about an axis; and an applicator head about which the material is passed, the head pressing the material against the surface, wherein the applicator head is at least partially located within a cylindrical space of unlimited length generated coaxially with the axis of the supply spool with a radius equal to the radius of a supply spool with a full supply of material.

29. The dispenser of claim 28, wherein each layer of material on the supply spool is in the form of a helical winding traversing substantially a full length of a winding region of the spool.

30. The dispenser of claim 28, wherein the maximum diameter of a winding region of the supply spool is in the central region of the spool.

31. The dispenser of claim 28, further including a guide, wherein the material from the supply spool passes through the guide before reaching the applicator head, the guide being movable along an axis parallel to the axis of the spool.

32. The dispenser of claim 28, wherein the applicator head is free to rotate about an axis.

33. The dispenser of claim 32, wherein the supply spool and applicator head rotate about the same axis.

34. The dispenser of claim 28, wherein the applicator head can swivel about an axis to fixed orientations.

35. The dispenser of claim 34, wherein the supply spool and applicator head rotate about the same axis.

36. The dispenser of any one of claim 6, 8, 33 or 35 further including an axle which is co-linear with the axis, the head being attached to the axle, the spool being rotatable about the axle.

37. The dispenser of claim 28, further including a housing for containing the spool, the housing being substantially cylindrical in shape.

38. The dispenser of claim 28, wherein the material is for correction.

39. The dispenser of claim 28, wherein the material is selected from the group consisting of materials for masking, highlighting, marking, labeling, transferring decals, scenting, gluing, bonding, adhering, removing debris, and materials in the cosmetic and medical areas.

40. The dispenser of claim 1 or 28, wherein the material is a tape having a width to length ratio of 0.01 or less.

41. The dispenser of claim 1 or 28, wherein the head can flex during use of the dispenser.

42. The dispenser of any one of claims 28–30 and 32–39, wherein the supply spool is also movable along the axis.

43. The dispenser of any one of claims 28 and 29–39, further including a take-up spool rotatable about an axis, the material passing from the supply spool about the applicator head and onto the take-up spool, wherein the applicator head is at least partially located within a cylindrical space of unlimited length generated around the axis of the spool closer to the applicator head or the common axis of coaxial spools, with a radius equal to the radius of the spool closer to the applicator head when this spool is full of material, or for coaxial spools, the larger spool when this spool is full.

44. The dispenser of claim 43, wherein the applicator head is free to rotate about an axis which is the same as the axis of either the supply spool or the take-up spool.

45. The dispenser of claim 43, wherein the spools are movable along their axes.

46. The dispenser of claim 45, wherein each layer of material on the supply spool and on the take-up spool is in the form of a helical winding traversing substantially a full length of a winding region of the spool.

47. The dispenser of claim 45, wherein the maximum diameters of the supply spool and the take-up spool are in the central region of a winding region of each spool.

48. The dispenser of claim 45, wherein the rotation of the supply spool drives the rotation of the take-up spool by means of one or more mechanical elements.

49. The dispenser of claim 48, wherein a clutch allows variation in a rotation rate of the take-up spool relative to a rotation rate of the supply spool.

50. The dispenser of claim 45, wherein the supply spool and the take-up spool are coaxial.

51. A dispenser for applying a material to a surface, comprising:

a supply spool rotatable about an axis;

a quantity of unused tape stored on the supply spool;

an applicator head about which the tape is passed, the head pressing the tape against a surface to deposit a transfer layer of the tape onto the surface;

a take-up spool for storing a backing layer of the tape after the transfer layer has been deposited on the surface, the take-up spool being rotatable about the axis;

a housing which surrounds at least a majority of the tape, a substantial portion of the housing being substantially cylindrical in shape; and means for guiding the tape from the supply spool to the head and from the head to the take-up spool, the applicator head being located substantially along the axis, the spools being movable along the axis, the tape causing movement of the spools along the axis as the spools are rotated about the axis, the tape being stored on each spool in a plurality of tape layers thick and a plurality of tape widths wide.

52. A dispenser for applying a material to a surface, comprising:

a spool rotatable about an axis;

a quantity of tape stored on the spool; and an applicator head around which the tape is passed, the head pressing the tape against a surface to deposit at least a portion of the tape on the surface, wherein the applicator head is located substantially along the axis.

53. The dispenser of claim 52, wherein the spool is a supply spool on which is stored unused tape.

54. The dispenser of claim 52, wherein the spool is a take-up spool on which is stored used tape.

55. The dispenser of claim 54, further including a supply spool on which is stored unused tape and which is rotatable about the axis, the tape passing from the supply spool, around the applicator head, and to the take-up spool.

56. The dispenser of claim 52, further comprising:

an axle about which the spool is rotatable, the applicator head being connected to one end of the axle.

57. The dispenser of claim 56, wherein the axle is rotatable about the axis.

58. The dispenser of claim 56, wherein the head is rotatable about the axis.

59. The dispenser of claim 56, wherein the axle and head are rotatable about the axis.

60. A dispenser for applying a material to a surface, comprising:

a spool rotatable about an axis, the spool being movable along the axis; and a quantity of tape stored on the spool, the tape causing movement of the spool along the axis as the spool is rotated about the axis.

61. The dispenser of claim 60, wherein the spool is a supply spool which stores unused tape.

62. The dispenser of claim 61, further including a take-up spool for storing used tape, the two spools being joined together such that in the axial dimension they move in unison along the axis.

63. A dispenser for applying a material to a single side of a planar surface, comprising:

a spool; and a quantity of tape stored on the spool, the tape having a thickness, a width and a length, the tape being stored on the spool in a plurality of tape layers thick and a plurality of tape widths wide;

wherein the spool is a take-up spool which stores used tape.

64. A dispenser for applying a material to a single side of a planar surface, comprising:

a supply spool;

a quantity of unused tape stored on the spool, the tape having a thickness, a width and a length, the tape being stored on the spool in a plurality of tape layers thick and a plurality of tape widths wide; and a take-up spool for storing used tape which is stored on the take-up spool in a plurality of tape layers thick and a plurality of tape widths wide.

65. A dispenser for applying a material to a single side of a planar surface, comprising:

a supply spool;

a quantity of unused tape stored on the spool, the tape having a thickness, a width and a length, the tape being stored on the spool in a plurality of tape layers thick and a plurality of tape widths wide;

an applicator head around which the tape is passed; and means for guiding the tape between the spool and the head, the spool being rotatable about an axis, movement of the tape between the spool and the head causing the spool to move along the axis due to the tape being stored on the spool in a plurality of tape widths wide.

66. The dispenser of claim 65, wherein the spool is a supply spool for storing unused tape.

67. The dispenser of claim 65, wherein the spool is a supply spool for storing unused tape, and further comprising:

a take-up spool for storing used tape, the used tape being stored on the take-up spool in a plurality of tape layers thick and a plurality of tape widths wide; and means for directing the tape between the head and the take-up spool, movement of the tape from the supply spool, around the head and to the take-up spool causing both spools to move along the axis due to the tape being stored on the supply spool in a plurality of tape widths wide.

68. The dispenser of claim 67, further comprising:

a clutch which allows the two spools to rotate about the axis relative to each other, the spools being joined together such that they move in tandem along the axis.

69. A dispenser for applying a material to a surface, comprising:

a spool rotatable about an axis;

a quantity of tape stored on the spool;

an applicator head around which the tape is passed, the head pressing the tape against a surface to deposit at least a portion of the tape on the surface, wherein a line of contact between the tape and the surface extends in a direction which intersects the axis.

70. The dispenser of claim 69, wherein the line of contact between the tape and the surface extends in a direction which intersects the axis at an acute angle.

71. The dispenser of claim 69, wherein the line of contact between the tape and the surface extends in a direction which intersects the axis at substantially a right angle.

72. A dispenser for applying a material to a single side of a planar surface, comprising:

a supply spool;

a quantity of unused tape stored on the spool, the tape having a thickness, a width and a length, the tape being stored on the spool in a plurality of tape layers thick and a plurality of tape widths wide;

wherein each tape layer wound on the spool is in the form of a helix traversing substantially a full axial length of a winding region of the spool.

73. The dispenser of claim 72, wherein each end portion of the winding region of the spool decreases in diameter towards its respective spool end to stabilize a turn in the winding at the end of each layer, in which turn a helix angle of the helically wound tape reverses, and to facilitate that reversal of helix angle between one helical layer and the next helical layer which spirals in the opposite direction.

* * * * *

UNITED STATES PATENT AND TRADEMARK OFFICE

CERTIFICATE OF CORRECTION

PATENT NO. : 6,499,524 B1 
DATED : December 31, 2002
INVENTOR(S) : Crispin R. Miller et al.

It is certified that error appears in the above-identified patent and that said Letters Patent is hereby corrected as shown below:

Title page,
Item [57], ABSTRACT,
Line 16, please delete "The-tape is" and replace with -- The tape is --.

Column 6,
Line 39, please delete "rotatable about an, axis," and replace with -- rotatable about an axis, --.

Signed and Sealed this

Twenty-first Day of October, 2003

JAMES E. ROGAN
*Director of the United States Patent and Trademark Office*